US007275528B1

(12) United States Patent
Daigler

(10) Patent No.: US 7,275,528 B1
(45) Date of Patent: Oct. 2, 2007

(54) FIXED IN-LINE ARROW HOLDER

(76) Inventor: David John Daigler, 1757 State Highway 162, Sprakers, NY (US) 12166

( * ) Notice: Subject to any disclaimer, the term of this patent is extended or adjusted under 35 U.S.C. 154(b) by 39 days.

(21) Appl. No.: 11/385,119

(22) Filed: Mar. 21, 2006

(51) Int. Cl.
*F41B 5/00* (2006.01)

(52) U.S. Cl. ..... 124/25.7; 124/44.5; 124/86

(58) Field of Classification Search ..... 124/23.1, 124/24.1, 25.5, 25.6, 25.7, 44.5, 86, 88; 224/916; 248/511, 519, 534
See application file for complete search history.

(56) References Cited

U.S. PATENT DOCUMENTS 2,801,625 A 8/1957 Vose
2,909,167 A 10/1959 Fredrickson
2,997,999 A 8/1961 Crowder
3,017,874 A * 1/1962 Gubash ..... 124/25.7
3,802,652 A * 4/1974 Holton, Jr. ..... 248/534
4,247,027 A 1/1981 Tardiff
4,270,724 A * 6/1981 McMullen ..... 248/534
4,823,764 A * 4/1989 Knaack ..... 124/88
5,259,359 A 11/1993 Meredith
5,280,777 A 1/1994 Pugh
6,892,717 B1 * 5/2005 Polanco et al. ..... 124/44.5

* cited by examiner

*Primary Examiner*—John A. Ricci

(57) ABSTRACT

A FIXED IN-LINE ARROW HOLDER consisting of a horizontal section 1, a corner section 2, a vertical section 3, a cross member section 4 and multiple arrow attachment points 6. When assembled and attached to an archery bow 11, the FIXED IN-LINE ARROW HOLDER provides a means for accepting and temporarily holding an second archery arrow 9 in close proximity to and in-line with another archery arrow 10 already loaded into shooting position on said archery bow 11. Having a second archery arrow 9 held in this position, will allow the second archery arrow 9 to be loaded into the shooting position with less motion and time than if the second archery arrow 9 was located further away.

9 Claims, 8 Drawing Sheets

FIXED IN-LINE ARROW HOLDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to archery arrow holders, specifically to such arrow holders that provide for quick loading of a second arrow after an initial arrow has been fired.

2. Background of the Invention

During the process of hunting live animals with an archery bow and arrow, it becomes necessary or desirable at times to fire or shoot more than 1 arrow at an animal in order to achieve the goal of fatally wounding the animal with an arrow. Because live animals are very weary, especially at the close ranges encountered when hunting with an archery bow and arrow, the animals typically run out of shooting range shortly after they hear the noise and see the movement associated with an initial arrow being fired. If it is necessary or desirable to fire or shoot a second arrow at an animal, the speed and stealth with which the second arrow is loaded directly affects whether or not the archer will have the opportunity to fire or shoot the second arrow before the animal moves out of range.

Thereafter, I have found several patented inventions that attempt to resolve the issue of quickly loading a second arrow onto an archery bow to increase an archer's chance of firing or shooting a second arrow at an animal before the animal moves out of range. However, all of these prior inventions have negative properties associated with their positive ones. All of the prior inventions contain moving parts that could fail or not work properly when operated in sometimes harsh and unpredictable outdoor environments. Most of the prior inventions take the place of the standard arrow rest or the arrow quiver on an archery bow. Because of that, an archer can not use any other arrow rest or arrow quiver that they desire in conjunction with any prior inventions. The prior inventions only show art work for either a right-handed or a left-handed bow and do not show the necessary modifications or the ability to be used without modification on both left-handed and right-handed bows.

BACKGROUND OF INVENTION—OBJECTS AND ADVANTAGES

Accordingly, several objects and advantages of my invention are:

(a) to provide a Fixed In-line Arrow Holder that has no moving parts once attached to an archery bow.

(b) to provide a Fixed In-line Arrow Holder that does not occupy the physical space that is typically occupied by the arrow rest or arrow quiver on an archery bow.

(c) to provide a Fixed In-line Arrow Holder that can be attached to an archery bow and be used in conjunction with any other arrow rest or arrow quiver already attached to the same archery bow.

(d) to provide a Fixed In-line Arrow Holder that will work without modification on either a right-handed or left-handed archery bow.

(e) to provide a Fixed In-line Arrow Holder that takes the general form of a "T".

(f) to provide a Fixed In-line Arrow Holder that is attached to an archery bow by way of a single mounting point.

(g) to provide a Fixed In-line Arrow Holder that when attached to an archery bow, does not touch the arrow rest attached to the same archery bow.

(h) to provide a Fixed In-line Arrow Holder that when attached to an archery bow, does not touch the arrow quiver attached to the same archery bow.

(i) to provide a Fixed In-line Arrow Holder that adjusts horizontally and vertically to compensate for different archery bow designs and archer preferences.

SUMMARY

In accordance with the present invention a Fixed In-line Arrow Holder comprising of an adjustable, "T" shaped bracket that is mounted to the stabilizer insert of an archery bow. Said bracket moves horizontally from said stabilizer insert, turns vertically toward the arrow rest of said archery bow and terminates with a cross member fitted with two attachment points for an archery arrow. Said attachment points provide a temporary means for holding said archery arrow in close proximity to and in-line with a different archery arrow already loading into the shooting position on said archery bow.

DRAWINGS—FIGURES

DRAWINGS—REFERENCE NUMERALS

1 HORIZONTAL SECTION
2 CORNER SECTION
3 VERTICLE SECTION
4 CROSS MEMBER SECTION
5 THREADED BOLT
6 ARROW ATTACHMENT POINT

7 THREADED STABILIZER INSERT LOCATION
8 FULL ASSEMBLED FIXED IN-LINE ARROW HOLDER
9 ARCHERY ARROW LOADED INTO FIXED IN-LINE ARROW HOLDER
10 ARCHERY ARROW LOADED INTO SHOOTING POSITION
11 TYPICAL MODERN ARCHERY BOW
12 ARROW REST
13 BOLT HOLES
14 NOCK OF FIRST ARROW
15 BOW STRING
16 BOW HANDLE
17 TARGET ANIMAL
18 LEFT HAND
19 RIGHT HAND
20 NOCK OF SECOND ARROW

DETAILED DESCRIPTION—FIG. 4A—PREFERRED EMBODIMENT

Figure 1A:
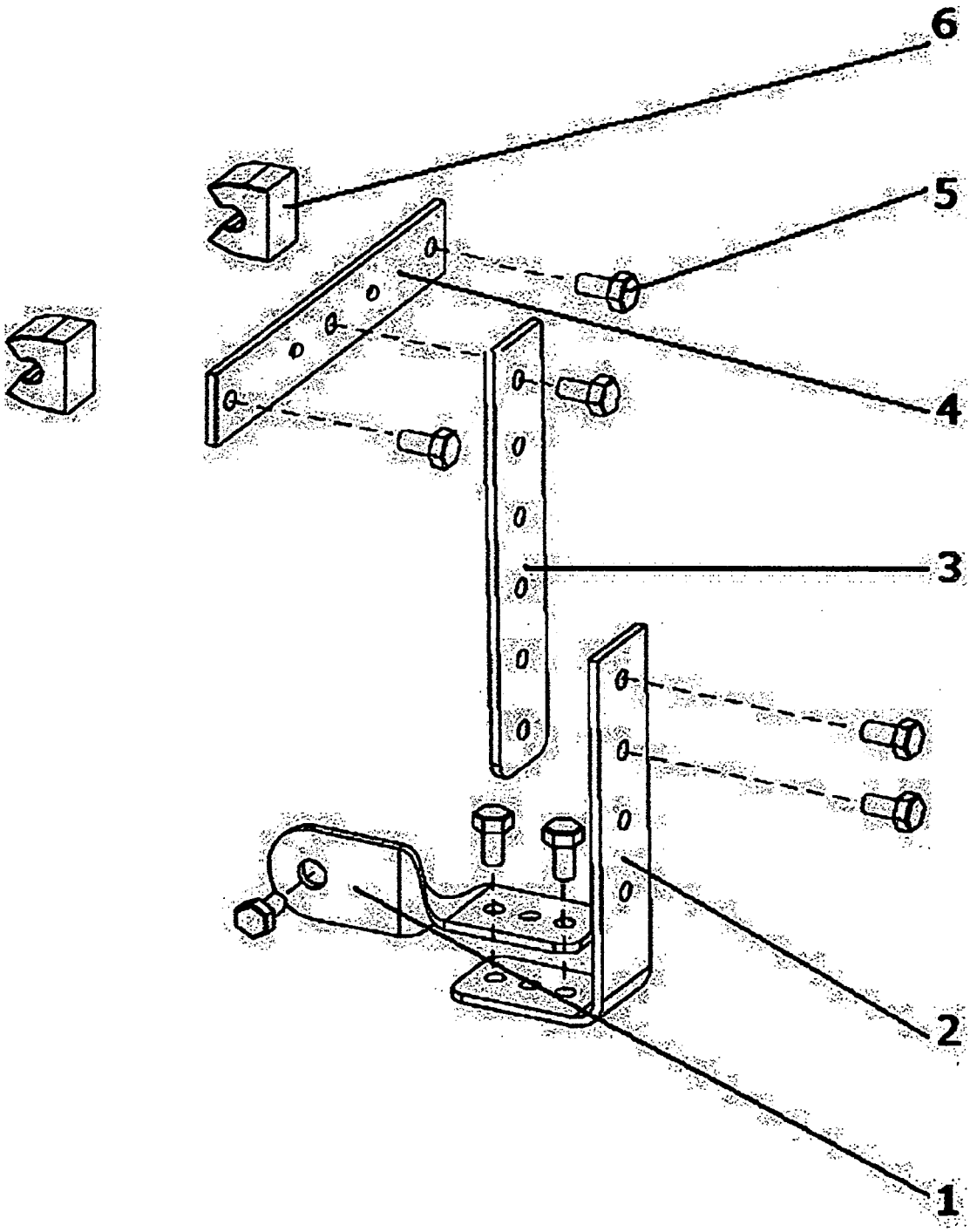
FIG. 1A shows an exploded view of the Fixed In-Line Arrow Holder from an angle.
Figure 2A:
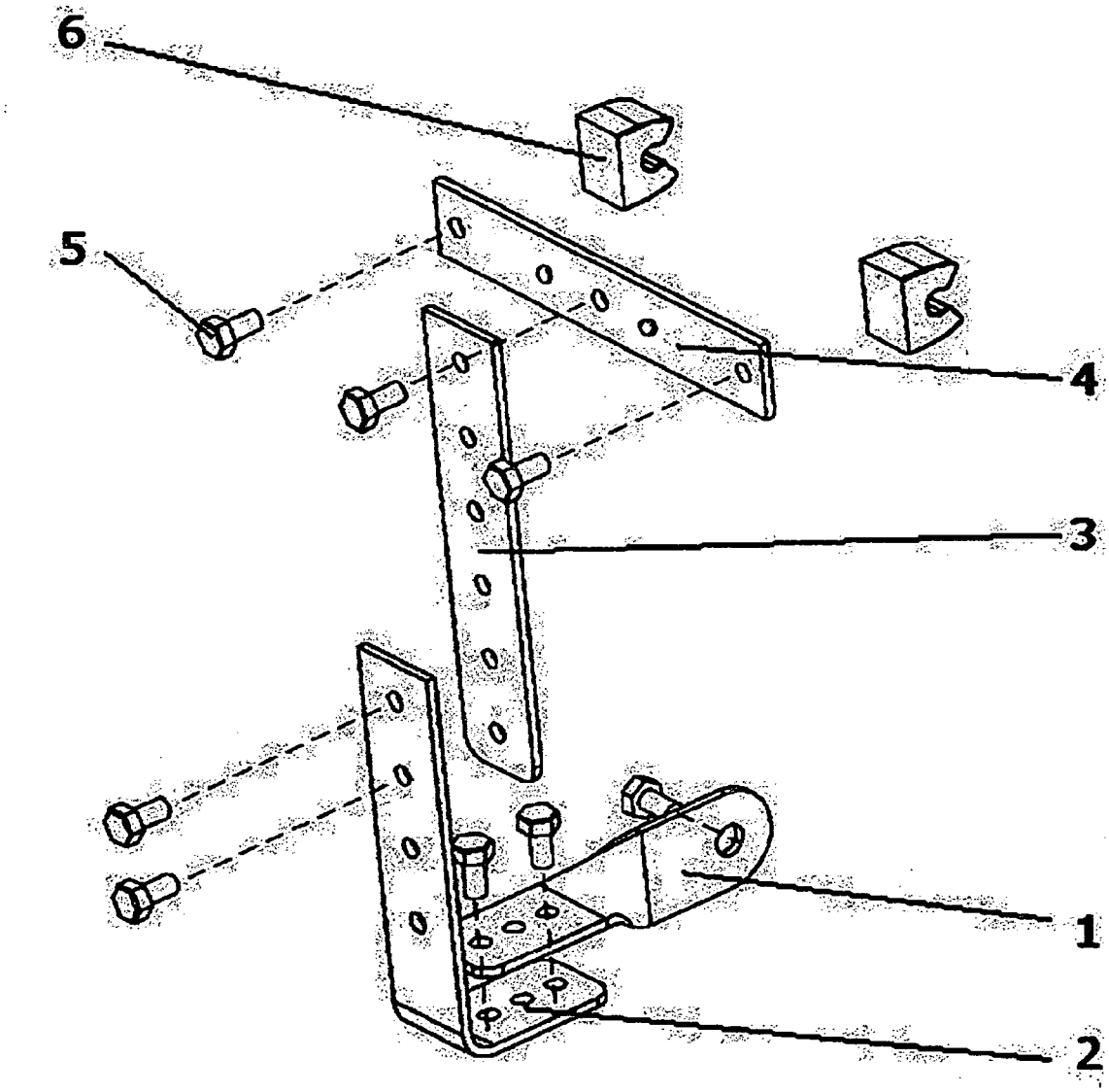
FIG. 2A shows an exploded view of the Fixed In-Line Arrow Holder from another angle.
Figure 3A:
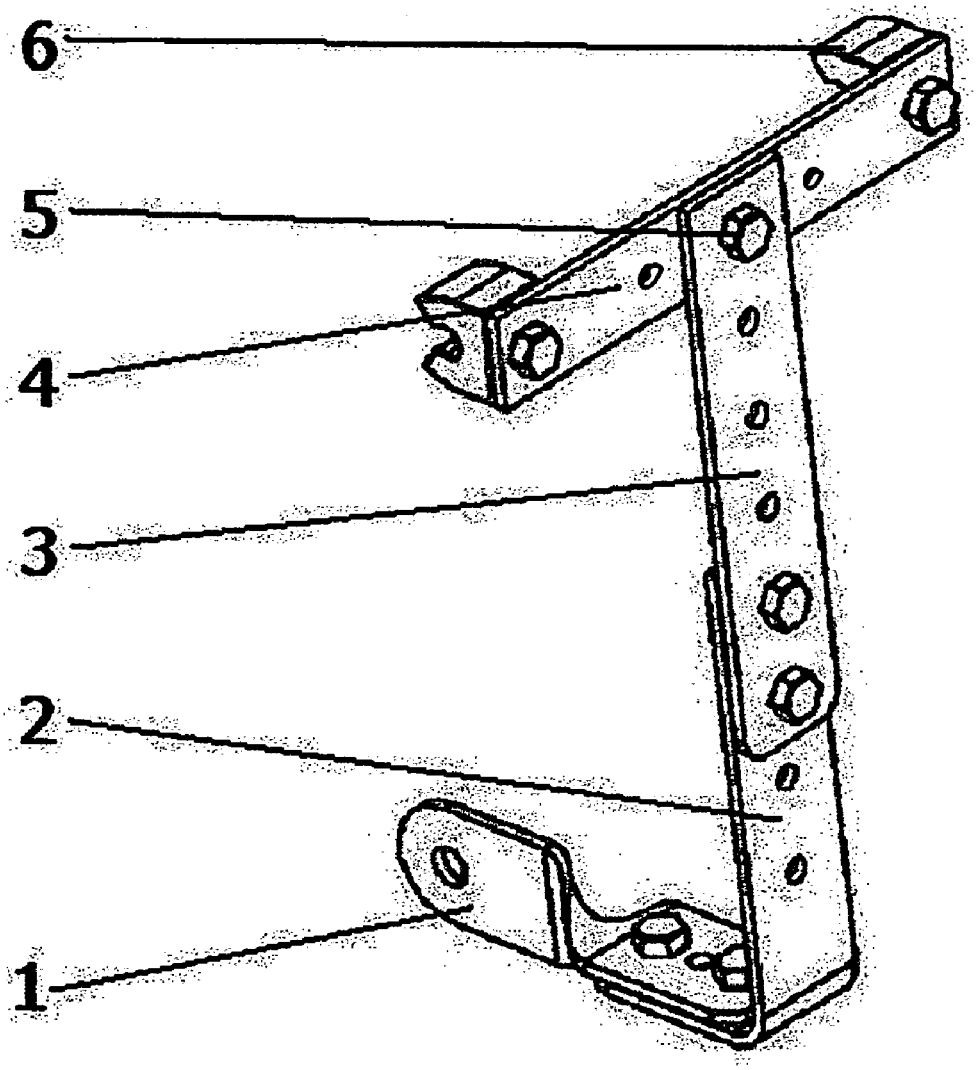
FIG. 3A shows an assembled view of the Fixed In-Line Arrow Holder from an angle.
Figure 4A:
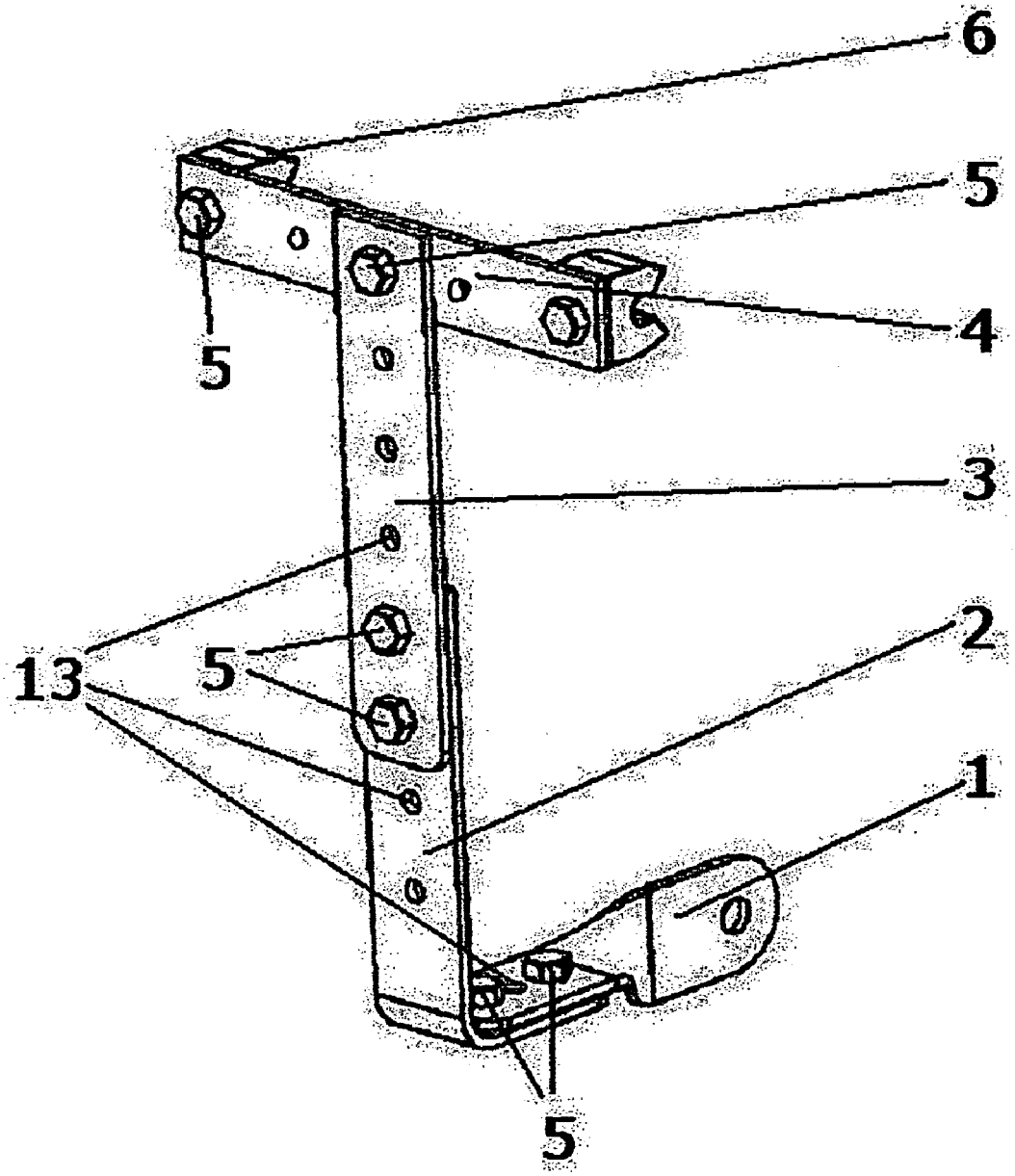
FIG. 4A shows an assembled view of the Fixed In-Line Arrow Holder from another angle.
Figure 5A:
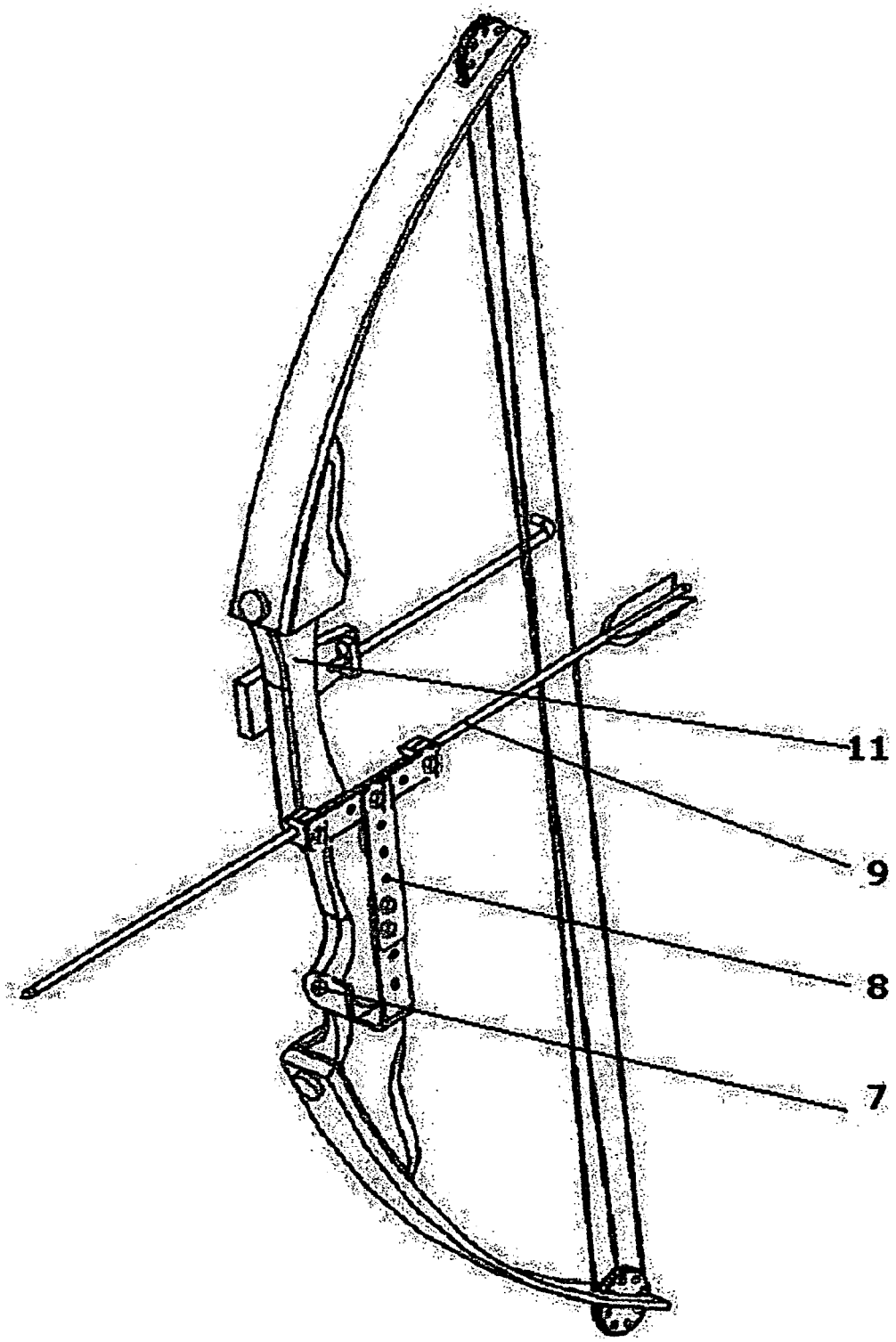
FIG. 5A shows an angled view of a fully assembled Fixed In-Line Arrow Holder attached to a modern day archery bow with an arrow attached to the Fixed In-Line Arrow Holder.
Figure 6A:
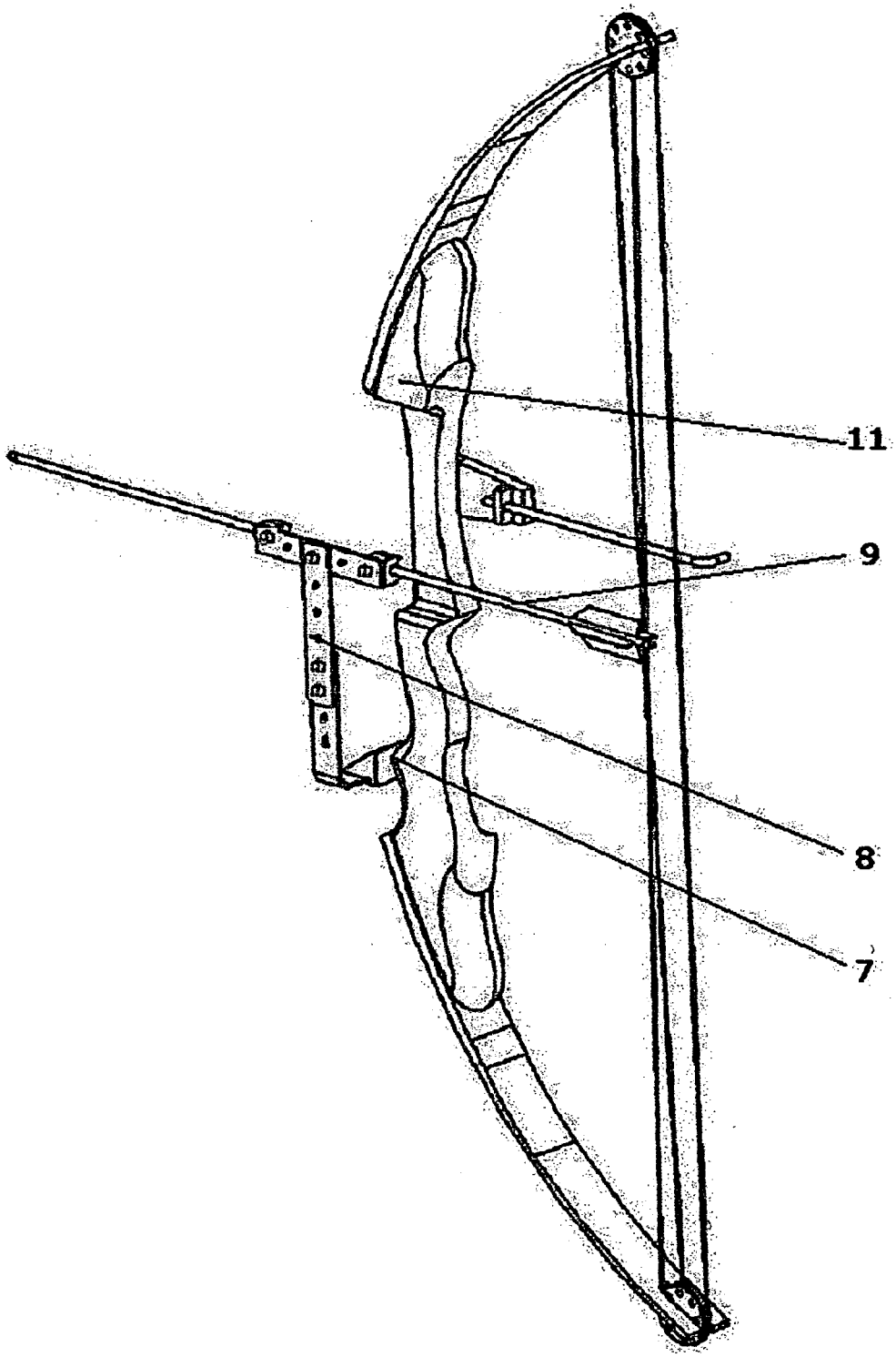
FIG. 6A shows a different angled view of a fully assembled Fixed In-Line Arrow Holder attached to a modern day archery bow with an arrow attached to the Fixed In-Line Arrow Holder.
Figure 7A:
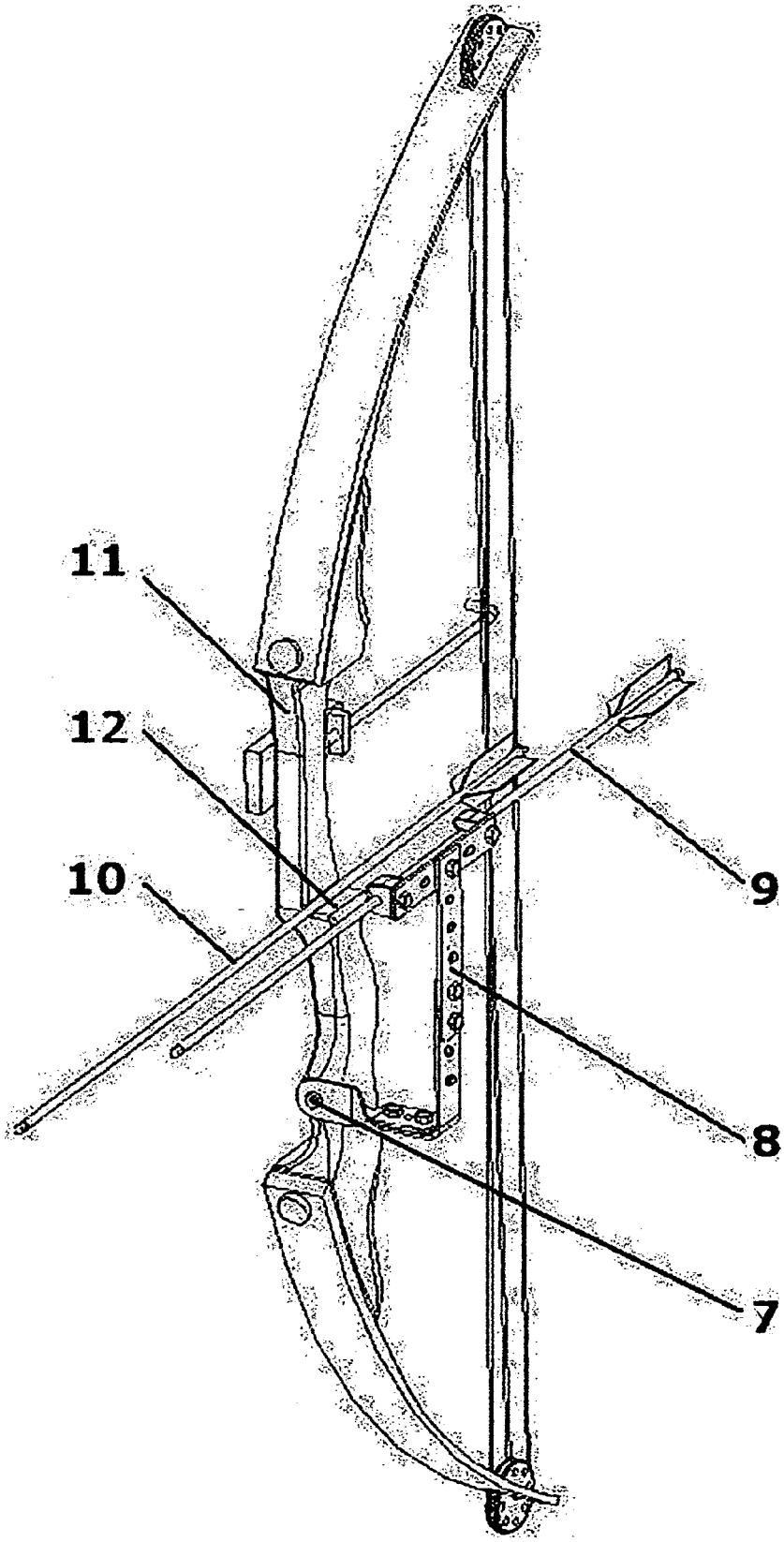
FIG. 7A shows an angled view of a fully assembled Fixed In-Line Arrow Holder attached to a modern day archery bow, an arrow attached to the Fixed In-Line Arrow Holder and a second arrow loaded into the normal shooting position on the bow.

A preferred embodiment of the FIXED IN-LINE ARROW HOLDER is illustrated in FIG. 4A. FIG. 4A shows that the arrow holder consists of a horizontal section 1 made of a piece of metal that is twisted 90 degrees in the center to provide for a vertical attachment to an archery bow and a horizontal attachment to a metal corner section 2. The corner section 2 is attached to the horizontal section 1 with 2 threaded bolts 5. The corner section 2 is then attached to a metal vertical section 3 with 2 more threaded bolts 5. The vertical section 3 is then attached to a metal cross member section 4 with 1 threaded bolt 5. At each end of the cross member section 4 is an arrow attachment point 6 made of molded rubber and attached by a threaded bolt 5. The horizontal section 1, the corner section 2 and the vertical section 3 all have a plurality of bolting holes 13. This allows the arrow holder to have some vertical and horizontal adjustment capabilities when mounted on a bow. Although the all the sections 1,2,3,4 are made of metal in the preferred embodiment, those pieces could be made of any other material that provides the required rigidity and durability. Although the arrow attachment points 6 are made of molded rubber in the preferred embodiment, they could be made of any other material that is resilient enough to grip an arrow securely.

Figure 8A:
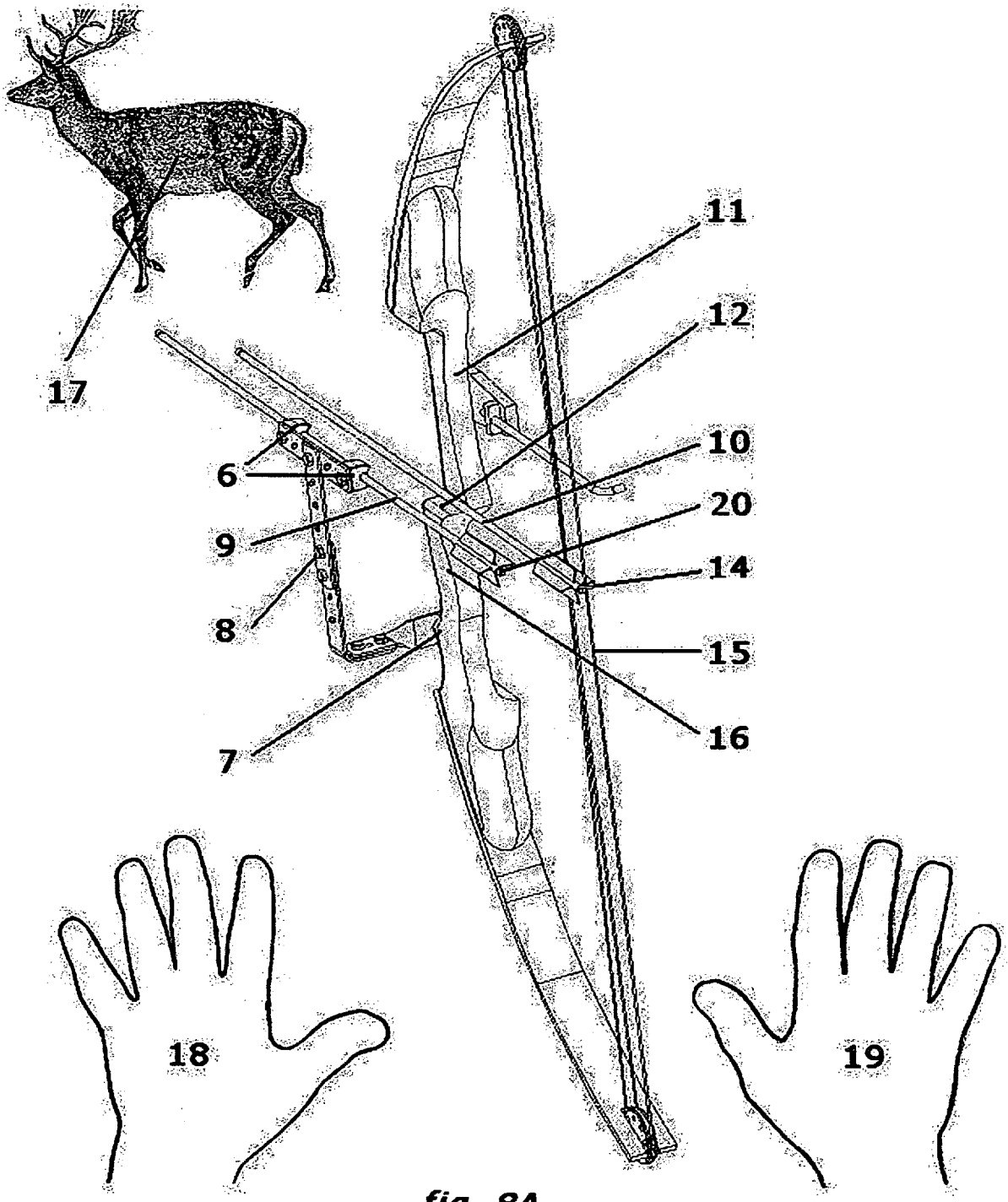
FIG. 8A shows a different angled view of a fully assembled Fixed In Line Arrow Holder attached to a modern day archery bow, an arrow attached to the Fixed In-Line Arrow Holder and a second arrow loaded into the normal shooting position on the bow.

Operation—FIG. 8A

The operation described below is for a right-handed bow and archer. However, the arrow holder 8 is designed to work without modification on a left-handed bow. For left handed operation, the arrow holder 8 would be mounted on the opposite side of the bow and the hands (left hand 18 or right hand 19) described below would be reversed.

Assemble the arrow holder 8 as shown. Attached the arrow holder 8 to a typical modern archery bow 11 by bolting it to the bow 11 at the threaded stabilizer insert location 7. Load an arrow 10 into the shooting position on the bow 11 by placing the arrow nock 14 onto the string 15 and allowing the front of the arrow 10 to sit on the arrow rest 12. Attach a second arrow 9 to the arrow holder 8 by pressing the arrow 9 into the arrow attachment points 6. While holding the handle of the bow 16 in the left hand 18, draw the string 15 back with the right hand 19 and aim at the target 17. Release the string 15 with the right hand 19 and allow the first arrow 10 to leave the bow 11. With the right hand 19, grab the nock 20 of the second arrow 9 while pushing the arrow 9 off of the arrow attachment points 6 with the index and middle fingers of the left hand 18 without letting go of the bow handle 16 with the left hand 18. Once the arrow 9 is released from the arrow attachment points 6, the arrow 9 can be guided to the arrow rest 12 with the fingers of the left hand 18 while placing the nock 20 of the arrow 9 onto the string 15 with the right hand 19. At this point, the string 15 can be pulled back with the right hand 19 while the left hand 18 continues to hold the handle 16 of the bow 11. After aiming at the target 17, release the string 15 with the right hand 19 and allow the second arrow 9 to leave the bow 11.

ADVANTAGES

From the description above, a number of advantages of my FIXED IN-LINE ARROW HOLDER become evident:

(a) the Fixed In-line Arrow Holder has no moving parts once attached to an archery bow.
(b) the Fixed In-line Arrow Holder does not occupy the physical space that is typically occupied by the arrow rest or arrow quiver on an archery bow.
(c) the Fixed In-line Arrow Holder can be attached to an archery bow and be used in conjunction with any other arrow rest or arrow quiver already attached to the same archery bow.
(d) the Fixed In-line Arrow Holder will work without modification on either a right-handed or left-handed archery bow.
(e) the Fixed In-line Arrow Holder attaches to an archery bow by way of a single mounting point.
(f) the Fixed In-line Arrow Holder will not touch the arrow rest attached to the same archery bow.
(g) the Fixed In-line Arrow Holder will not touch the arrow quiver attached to the same archery bow.
(h) the Fixed Inline Arrow Holder adjusts horizontally and vertically to compensate for different archery bow designs and archer preferences.

Although the description above contains many specifications, these should not be construed as limiting the scope of the invention but as merely providing illustrations of some of the presently preferred embodiments of this invention. For example, the bracket can be made of other materials and have different shapes, the arrow attachment points can be made of other materials. In an alternate embodiment, the horizontal, corner, vertical and cross member sections could be replaced by a one piece, similarly shaped bracket that is not adjustable.

Thus, the scope of the invention should be determined by the appended claims and their legal equivalents, rather than by the examples given.

I claim:

1. A fixed structure for temporarily holding an archery arrow in close proximity to and in-line with another archery arrow already loaded into shooting position on an archery bow, comprising:

(a) a horizontal section that has a hole in one end so it can be attached at the stabilizer insert location of an archery bow;
(b) said horizontal section having a means for attaching and adjusting a corner section at the other end of said horizontal section;
(c) said corner section having a means for being attached to said horizontal section at one end of said corner section;
(d) said corner section having a means for attaching and adjusting a vertical section to the other end of said corner section;

(e) said vertical section having a means of being attached to said corner section on one end;

(f) said vertical section having a means of attaching and adjusting a horizontal cross member at the other end of said vertical section;

(g) said horizontal cross member having a means of being attached to said vertical section;

(h) said horizontal cross member having multiple, resilient attachment points;

(i) said resilient attachment points capable of accepting and temporarily holding an archery arrow in close proximity to and in-line with another archery arrow already loaded into the shooting position on said archery bow.

2. The fixed structure of claim 1 wherein said fixed structure has no moving parts after said fixed structure is attached to said archery bow.

3. The fixed structure of claim 1 wherein said fixed structure does not occupy the physical space that is typically occupied by the arrow rest or arrow quiver on said archery bow.

4. The fixed structure of claim 1 wherein said fixed structure can be used in conjunction with any other arrow rest or arrow quiver already attached to said archery bow.

5. The fixed structure of claim 1 wherein said fixed structure can attach to and operate without modification on either a right-handed or left-handed archery bow.

6. The fixed structure of claim 1 wherein said fixed structure attaches to said archery bow by way of a single mounting point.

7. The fixed structure of claim 1 wherein said fixed structure will not touch a separate arrow rest attached to said archery bow.

8. The fixed structure of claim 1 wherein said fixed structure will not touch a separate arrow quiver attached to said archery bow.

9. The fixed structure of claim 1 wherein said fixed structure adjusts horizontally and vertically to compensate for different archery bow designs and archer preferences.

* * * * *